US007416615B2

(12) United States Patent
Bano et al.

(10) Patent No.: US 7,416,615 B2
(45) Date of Patent: Aug. 26, 2008

(54) VERY-HIGH-STRENGTH AND LOW-DENSITY, HOT-ROLLED STEEL SHEET AND MANUFACTURING PROCESS

(75) Inventors: Xavier Bano, Istres (FR); Christian Giraud, Miramas (FR)

(73) Assignee: USINOR, Puteaux (FR)

( * ) Notice: Subject to any disclaimer, the term of this patent is extended or adjusted under 35 U.S.C. 154(b) by 442 days.

(21) Appl. No.: 10/507,641

(22) PCT Filed: Mar. 10, 2003

(86) PCT No.: PCT/FR03/00765

§ 371 (c)(1),
(2), (4) Date: Aug. 30, 2005

(87) PCT Pub. No.: WO03/076673

PCT Pub. Date: Sep. 18, 2003

(65) Prior Publication Data

US 2006/0231177 A1 Oct. 19, 2006

(30) Foreign Application Priority Data

Mar. 11, 2002 (FR) ..... 02 02998

(51) Int. Cl.
*C22C 38/02* (2006.01)
*C22C 38/04* (2006.01)
*C22C 38/06* (2006.01)
*C21D 7/13* (2006.01)

(52) U.S. Cl. ..... 148/320; 148/330; 148/333; 148/334; 148/335; 148/336; 148/648; 148/602; 420/78; 420/117; 420/118

(58) Field of Classification Search ..... 420/77–78, 420/103–106, 117–118, 108–112, 121, 123–127, 420/120; 148/333–336, 324, 602, 621, 648, 148/320, 330
See application file for complete search history.

(56) References Cited

U.S. PATENT DOCUMENTS 5,445,685 A 8/1995 Strum et al.

FOREIGN PATENT DOCUMENTS

| | | |
|---|---|---|
| EP | 60-204833 A | 10/1985 |
| EP | 0 377 734 A | 7/1990 |
| EP | 3-291360 A | 12/1991 |
| EP | 0 495 121 A1 | 7/1992 |
| EP | 7-3397 A | 1/1995 |
| EP | 7-252592 A | 10/1995 |

(Continued)

OTHER PUBLICATIONS

Computer-generated English translation of Japanese patent 08-060305 dated Mar. 5, 1996, Kono Osamu et al.*

*Primary Examiner*—Deborah Yee
(74) *Attorney, Agent, or Firm*—Sughrue Mion, PLLC

(57) ABSTRACT

The invention relates to a high-resistant, low-density hot laminated sheet steel comprising the following elements expressed in weight per cent: 0.04%:9 carbon≦0.5%; 0.05%≦manganese≦3%, being able to contain hardening elements: 0.01%≦niobium≦0.1 0.01%≦titanium≦0.2% 0.01≦vanadium≦0.2%, either individually or combined, and/or elements acting on the transformation temperatures, 0.0005%≦boron≦0.005%; 0.05%≦nickel≦2%; 0.05%≦chrome≦2%; 0.05%≦molybdenum≦2%, either individually or combined, the remainder being iron and elements which are inherent to production, characterized in that it comprises: 2%≦silicon≦10%; 1%≦aluminium≦10%. The invention also relates to the production thereof.

12 Claims, 3 Drawing Sheets

FOREIGN PATENT DOCUMENTS

| | | | | |
|---|---|---|---|---|
| EP | 7-300655 | A | | 11/1995 |
| EP | 10-25543 | A | | 1/1998 |
| EP | 2001-254138 | A | | 9/2001 |
| JP | 08 060305 | A | | 7/1996 |
| JP | 10 212522 | A | | 8/1998 |
| JP | 11-323489 | A | | 11/1999 |
| JP | 2000-160249 | | * | 6/2000 |
| WO | WO 93013231 | A | | 7/1993 |

* cited by examiner

VERY-HIGH-STRENGTH AND LOW-DENSITY, HOT-ROLLED STEEL SHEET AND MANUFACTURING PROCESS

The invention relates to a very-high-strength and low-density, hot-rolled steel sheet, obtained from a strip rolling mill, and to its manufacturing process.

BACKGROUND OF THE INVENTION

It is becoming a necessity to lighten motor vehicles because of the requirement to reduce $CO_2$ emissions to 140 g/Km by 2008. This lightening may be achieved only by increasing the level of mechanical strength of steels in order to compensate for the reduction in sheet thickness. It is therefore necessary to increase the mechanical properties while reducing the thicknesses of the sheet with which the parts used are produced. This approach reaches its limits with the reduction in rigidity of the parts and the appearance of noise and vibrations unacceptable in the intended applications in the automobile field, where noise is a discomfort.

DESCRIPTION OF THE PRIOR ART

In the field of hot-rolled flat steel products, the mechanical properties of which are obtained by controlled rolling on a wide-strip mill, the highest strength level is obtained with very high strength steels of bainitic structure, which allow a mechanical strength level of between 800 MPa and 1000 MPa to be achieved, but their density is that of a standard steel, that is to say a density of 7.8 g/cm$^3$.

It is also possible to obtain a steel of lower density using an addition element such as aluminum, in which steel an addition of 8.5% aluminum allows the density to be lowered to 7 g/cm$^3$. This solution does not allow mechanical strength levels of greater than 480 MPa to be achieved. Adding other addition elements, such as chromium, vanadium and niobium, with contents ranging up to 1%, 0.1% and 0.4% respectively, does not allow a mechanical strength level of 580 MPa to be exceeded. In this approach, the reduction in density is cancelled out by the poor mechanical strength properties obtained.

SUMMARY OF THE INVENTION

The object of the invention is to offer users of hot-rolled steel sheets a low-density sheet having strength levels comparable to the high-strength steel sheet currently used, or even of a higher level, and to do so in order to combine the two advantages of low density and high mechanical strength.

The first subject of the invention is a very-high-strength and low-density, hot-rolled steel sheet, characterized in that its composition in % by weight comprises:

0.04%≦carbon≦0.5%

0.05%≦manganese≦3% and optionally the following hardening elements:

0.01%≦niobium≦0.1%

0.01%≦titanium≦0.2%

0.01%≦vanadium≦0.2%, taken individually or in combination, and/or elements that act on the transformation temperatures:

0.0005%≦boron≦0.005%

0.05%≦nickel≦2%

0.05%≦chromium≦2%

0.05%≦molybdenum≦2%, taken individually or in combination, the balance being iron and elements inherent in smelting, characterized in that it includes:

2%≦silicon≦10%,

1%≦aluminum≦10%.

In a preferred embodiment of the invention, the steel includes in its composition, in % by weight:

0.04%≦carbon≦0.3%

0.08%≦manganese≦3%

2%≦silicon≦6%

1%≦aluminum≦10%.

In another preferred embodiment, the sheet according to the invention is such that the silicon content is between 3 and 6% and that the aluminum content is between 1 and 2%.

In another preferred embodiment, the sheet according to the invention is such that the silicon content is between 2 and 3% and that the aluminum content is between 7 and 10%.

In another preferred embodiment, the silicon and aluminum contents of the sheet according to the invention are such that:

$$\%\ Si + \%\ Al \geqq 9.$$

The sheet according to the invention may also have the following features, individually or in combination:

- the sheet has a microstructure consisting of a primary ferrite phase and of a secondary ferrite phase, the mean grain size of said primary ferrite being greater than the mean grain size of said secondary ferrite, said microstructure also containing carbide phases,
- the sheet has a primary ferrite phase obtained during the reheating of the steel carried out prior to the hot rolling, and a secondary ferrite phase obtained after the hot rolling, and also carbide phases;
- the sheet comprises a primary ferrite phase, the mean grain size of which is greater than 5 μm, and a secondary ferrite phase whose mean grain size is of less than 2 μm.

The second subject of the invention is a process for manufacturing a hot-rolled sheet, which comprises the steps consisting in:

- reheating a slab, the composition of which is in accordance with the invention, thus forming a slab whose microstructure comprises a primary ferrite phase and an austenite phase; and then
- hot-rolling said slab, the temperature at the end of hot rolling being above the AR3 temperature of the austenitic phase formed during the reheat, so as to carry out rolling under austenitic conditions, thus transforming the austenitic phase into a secondary ferrite phase and carbide phases.

BRIEF DESCRIPTION OF THE DRAWINGS

The invention will be clearly understood from the description that follows, given with reference to the appended figures which represent.

DESCRIPTION OF THE PREFERRED EMBODIMENTS

The steel according to the invention, hot-rolled on a strip rolling mill, has a high mechanical strength and a low density.

The steel has the following general composition by weight:

0.04%≦carbon≦0.5%

0.05%≦manganese≦3% possibly containing the hardening elements:

0.01%≦niobium≦0.1%

0.01%≦titanium≦0.2%

0.01≦vanadium≦0.2%, taken individually or in combination and/or the elements that act on the transformation temperatures:

0.0005%≦boron≦0.005%

0.05%≦nickel≦2%

0.05%≦chromium≦2%

0.05%≦molybdenum≦2%, taken individually or in combination, the balance being iron and elements inherent in smelting and includes:

2%≦silicon≦10%,

1%≦aluminum≦10%.

The carbon content of the sheet according to the invention is between 0.04 and 0.5% by weight, preferably between 0.04 and 0.3% by weight. The change in structure of the steel as a function of the carbon content is shown in FIGS. 2 to 5 and indicates that the structure of the steel according to the invention (FIGS. 2 to 4) consists of coarse-grained primary ferrite and of a mixture of carbide phases and of fine secondary ferrite with smaller grains. If the carbon content falls below 0.04%, the microstructure contains no carbide phases and loses mechanical properties. In contrast, if the carbon content exceeds 0.5% by weight, the structure becomes very brittle and it is observed that the microstructure no longer contains primary ferrite (cf. FIG. 5).

Figure 1:
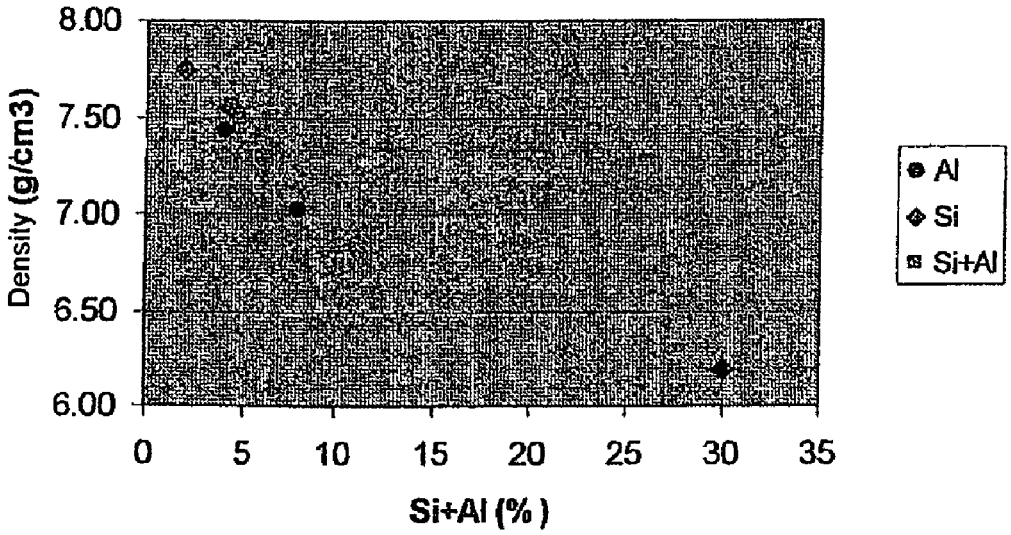
in FIG. 1, a curve showing the variation in the density of a steel as a function of the silicon content, the aluminum content and/or the silicon plus aluminum content.
Figure 2:
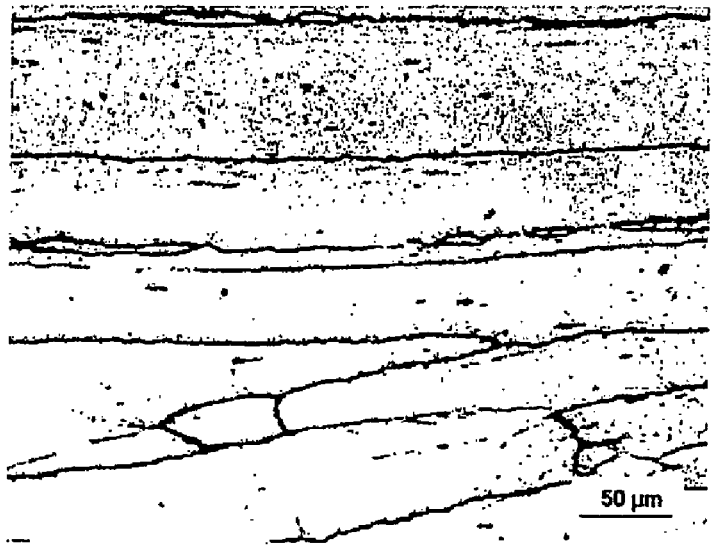
in FIG. 2, the microstructure of a steel according to the invention containing 0.04% carbon (heat I)
Figure 3:
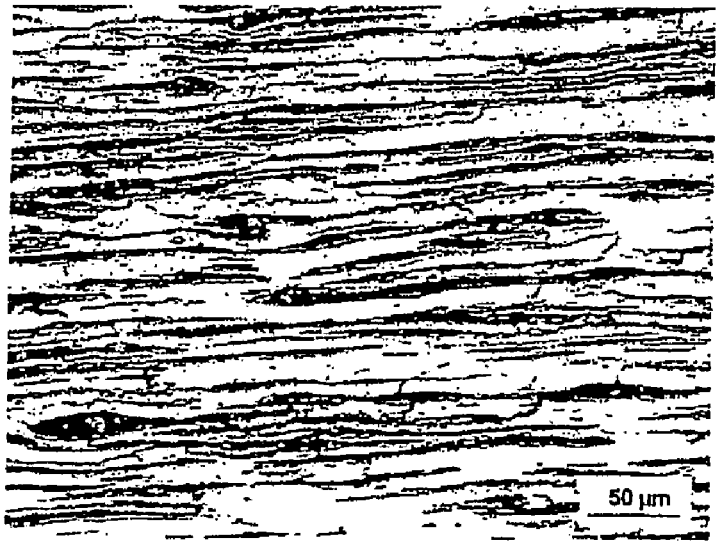
in FIG. 3, the microstructure of a steel according to the invention containing 0.160% carbon (heat J)
Figure 4:
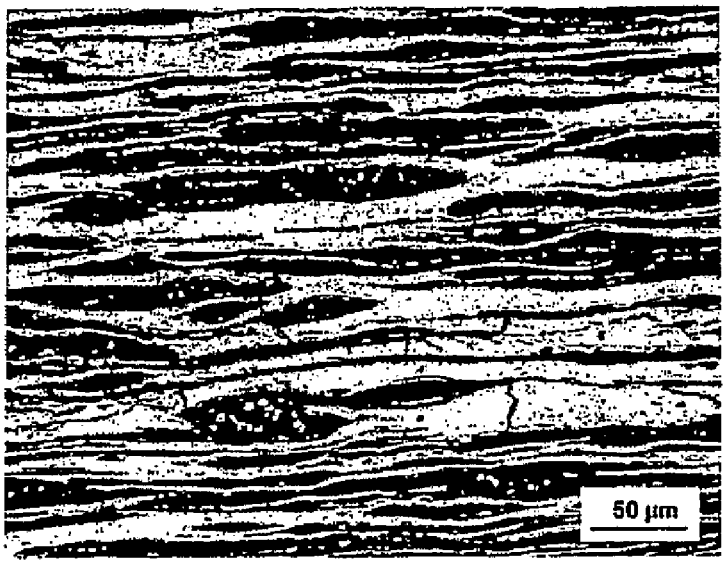
in FIG. 4, the microstructure of a steel according to the invention containing 0.268% carbon (heat K); and in FIG. 5, the microstructure of a steel containing 0.505% carbon (heat L), the steel being shown for comparison.
Figure 5:
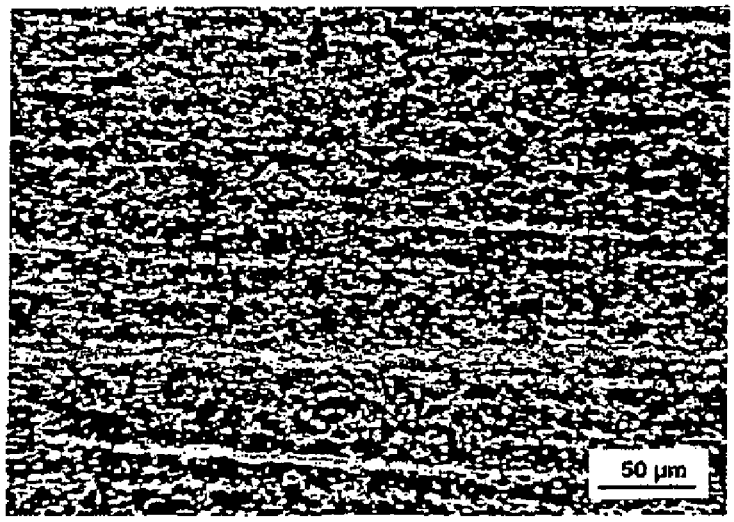

Without wishing to be bound by any theory, it is believed that the formation of this novel microstructure is due to the combination of carbon, silicon and aluminum contents. It makes it possible to achieve excellent mechanical properties. Specifically, the steel according to the invention may reach mechanical strength levels ranging from 620 MPa to more than 1000 MPa and densities of around 7.55 and dropping to 7 g/cm$^3$, depending on the silicon and aluminum contents and the contents of additional elements, as shown in FIG. 1.

The mechanical properties may be enhanced by addition of a microalloying element, such niobium, titanium or vanadium, the last two being less dense than iron.

The sheet according to the invention can be manufactured by any suitable process.

However, it is preferred to use the process according to the invention. This process firstly comprises reheating the slab to a high temperature (preferably above 900° C.), prior to the hot rolling. The present inventors have discovered that, during this reheat step, the slab has a microstructure composed of what is called a primary ferritic phase, which forms at high temperature and coexists with an austenitic phase.

By hot rolling in such a way that the end-of-rolling temperature remains above the AR3 value calculated for the austenitic phase alone, rolling takes place under austenitic conditions.

It is observed that the austenitic phase then completely transforms into a carbide phase/secondary ferrite mixture, the mean grain size of which is less than that of the primary ferrite phase, which remains.

Advantageously, a carbon-manganese pair will be chosen so as to have an AR3 transformation temperature such that rolling under austenitic conditions can be guaranteed.

Table 1 below, giving the various compositions according to the invention, shows the influence of the various elements on the properties of the steels.

TABLE 1

The heats A, C, F, H and L are given for comparison, whereas the heats B, D, E, G, I, J and K are according to the invention.

| | C % | Mn % | Si % | Al % | $R_m$ (MPa) | Density |
|---|---|---|---|---|---|---|
| A | 0.24 | 2.46 | 1.83 | <0.1 | 1423 | 7.74 |
| B | 0.23 | 2.53 | 3.06 | 1.28 | 902 | 7.54 |
| C | 0.12 | 2.55 | 4.09 | <0.1 | 1296 | 7.55 |
| D | 0.07 | 2.67 | 5.28 | 5 | 1400 | 7.14 |
| E | 0.068 | 1.29 | 3.23 | 1.423 | 750 | 7.52 |
| F | 0.079 | 1.21 | 1.44 | 3.25 | 587 | 7.44 |
| G | 0.042 | 1.37 | 3.27 | 1.43 | 760 | 7.51 |
| H | 0.204 | 2.62 | <0.1 | 8.05 | 673 | 7.02 |
| I | 0.040 | 1.688 | 3.66 | 1.075 | 621 | 7.55 |
| J | 0.160 | 1.270 | 3.69 | 1.153 | 835 | 7.52 |
| K | 0.268 | 1.155 | 3.59 | 1.435 | 949 | 7.51 |
| L | 0.505 | 0.167 | 3.48 | 1.041 | 1134 | 7.54 |

The data presented in table 1 show that aluminum by itself does not make it possible to obtain both a low density of the steel and a high strength level of said steel.

In the example of the steel referenced E, the rolling temperature was 895° C. and the coiling temperature was 600° C., with a cooling rate of 49° C./s, giving the steel a mechanical strength of 750 MPa. By lowering the coiling temperature, it is possible to increase the mechanical strength level.

This is the case of the example of the steel referenced B, the coiling temperature of which was 20° C. with a cooling rate of 5° C./s, thereby making it possible to achieve a mechanical strength level of 902 MPa.

By increasing the cooling rate in the case of a steel referenced C, produced by rolling at a temperature of 870° C., coiling at a temperature of 120° C. and with a cooling rate of 130° C./s, a steel with a mechanical strength of 1296 MPa is obtained.

The mechanical strength level may also be adjusted by carbon and manganese contents and/or by the contents of other additional elements as given above. Certain operations, such as for example re-rolling or a heat treatment such as an annealing operation, may be used to modify or adjust the level of the mechanical properties.

According to the invention, the proposed steel meets two contradictory requirements in the hot-rolled steel field of, on the one hand, high mechanical properties and, on the other hand, low density. The existing solutions for producing steels of very high mechanical strength levels are based on the use of addition elements that do not allow a substantial change in density, and the existing solutions for producing low-density steels are based on the use of addition elements that do not allow a high mechanical strength level to be achieved.

The steel of the invention combines these two properties, namely a high mechanical strength level and a very low density, in order to lighten a part that can be used in automobiles.

The invention claimed is:

1. A very-high-strength and low-density, hot-rolled steel sheet, comprising, in % by weight:

0.04%≦carbon≦0.5%

0.05%≦manganese≦3% the balance being iron and elements inherent in smelting, characterized in that it includes:

2%≦silicon≦10%,

1%≦aluminum≦10%, and in that said sheet further has a microstructure consisting of a primary ferrite phase and of a secondary ferrite phase, the mean grain size of said primary ferrite being greater than the mean grain size of said secondary ferrite, said microstructure also containing carbide phases.

2. The sheet as claimed in claim 1, further characterized in that said composition comprises:

0.04%≦carbon≦0.3%

0.08%≦manganese≦3%

2%≦silicon≦6%

1%≦aluminum≦10%.

3. The sheet as claimed in claim 1 or 2, further characterized in that the silicon content is between 3 and 6% and in that the aluminum content is between 1 and 2%.

4. The sheet as claimed in claim 1 or 2, further characterized in that the silicon content is between 2 and 3% and in that the aluminum content is between 7 and 10%.

5. The sheet as claimed claim 1 or 2, further characterized in that the silicon and aluminum contents are such that:

$$\%\ Si + \%\ Al \geqq 9.$$

6. The sheet as claimed in claim 1 or 2, further characterized in that said primary ferrite phase is obtained during the reheating of the steel carried out prior to the hot rolling, and said secondary ferrite phase is obtained after the hot rolling.

7. The sheet as claimed in claim 1 or 2, characterized in that said primary ferrite phase has a mean grain size of greater than 5 μm and in that said secondary ferrite phase has a mean grain size of less than 2 μm.

8. A process for manufacturing a hot-rolled sheet comprising the steps consisting in: reheating a slab having, the composition according to claim 1 or 2, thus forming a slab whose microstructure comprises a primary ferrite phase and an austenite phase; and then hot-rolling said slab, the temperature at the end of hot rolling being above the AR3 temperature of the austenitic phase formed during the reheat, so as to carry out rolling under austenitic conditions, thus transforming the austenitic phase into a secondary ferrite phase and carbide phases.

9. A process of manufacturing motor vehicles comprising molding a hot-rolled steel sheet into a part of a motor vehicle, wherein 0.04%≦carbon≦0.5%

0.05%≦manganese≦3% the balance being iron and elements inherent in smelting, characterized in that it includes:

2%≦silicon≦10%,

1%≦aluminum≦10%.

and in that said sheet further has a microstructure consisting of a primary ferrite phase and of a secondary ferrite phase, the mean grain size of said primary ferrite being greater than the mean grain size of said secondary ferrite, said microstructure also containing carbide phases.

10. The sheet as claimed in claim 1 or 2, further comprising at least one of the following hardening elements:

0.01%≦niobium≦0.1%

0.01%≦titanium≦0.2%

0.01%≦vanadium≦0.2%.

11. The sheet as claimed in claim 1 or 2, further comprising at least one of the following elements that act on the transformation temperatures:

0.0005%≦boron≦0.005%

0.05%≦nickel≦2%

0.05%≦chromium≦2%

0.05%≦molybdenum≦2%.

12. The sheet as claimed in claim 10, further comprising at least one of the following elements that act on the transformation temperatures:

0.0005%≦boron≦0.005%

0.05%≦nickel≦2%

0.05%≦chromium≦2%

0.05%≦molybdenum≦2%.

* * * * *